US010014005B2

(12) United States Patent
Sun et al.

(10) Patent No.: US 10,014,005 B2
(45) Date of Patent: Jul. 3, 2018

(54) HARMONICITY ESTIMATION, AUDIO CLASSIFICATION, PITCH DETERMINATION AND NOISE ESTIMATION

(71) Applicant: DOLBY LABORATORIES LICENSING CORPORATION, San Francisco, CA (US)

(72) Inventors: Xuejing Sun, Beijing (CN); Zhiwei Shuang, Beijing (CN); Shen Huang, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/384,356

(22) PCT Filed: Mar. 21, 2013

(86) PCT No.: PCT/US2013/033232
§ 371 (c)(1),
(2) Date: Sep. 10, 2014

(87) PCT Pub. No.: WO2013/142652
PCT Pub. Date: Sep. 26, 2013

(65) Prior Publication Data

US 2015/0081283 A1 Mar. 19, 2015

Related U.S. Application Data

(60) Provisional application No. 61/619,219, filed on Apr. 2, 2012.

(30) Foreign Application Priority Data

Mar. 23, 2012 (CN) ..... 2012 1 0080255

(51) Int. Cl.
*G10L 25/00* (2013.01)
*G10L 25/78* (2013.01)
(Continued)

(52) U.S. Cl.
CPC ..... *G10L 25/78* (2013.01); *G10L 25/18* (2013.01); *G10L 25/81* (2013.01); *G10L 25/84* (2013.01)

(58) Field of Classification Search
None
See application file for complete search history.

(56) References Cited

U.S. PATENT DOCUMENTS 5,195,166 A 3/1993 Hardwick
5,272,698 A 12/1993 Champion
(Continued)

FOREIGN PATENT DOCUMENTS

EP 1744303 1/2007
WO 2011/103488 8/2011

OTHER PUBLICATIONS

Xeijing Sun "Pitch Determination and Voice Quality Analysis Using Subharmonic-to-harmonic ratio" ICASSP 2002 pp. 333-336.*
(Continued)

*Primary Examiner* — Pierre-Louis Desir
*Assistant Examiner* — Yi-Sheng Wang

(57) ABSTRACT

Embodiments are described for harmonicity estimation, audio classification, pitch determination and noise estimation. Measuring harmonicity of an audio signal includes calculation a log amplitude spectrum of audio signal. A first spectrum is derived by calculating each component of the first spectrum as a sum of components of the log amplitude spectrum on frequencies. In linear frequency scale, the frequencies are odd multiples of the component's frequency of the first spectrum. A second spectrum is derived by calculating each component of the second spectrum as a sum of components of the log amplitude spectrum on frequencies. In linear frequency scale, the frequencies are even multiples of the component's frequency of the second spectrum. A difference spectrum is derived subtracting the first
(Continued)

spectrum from the second spectrum. A measure of harmonicity is generated as a monotonically increasing function of the maximum component of the difference spectrum within predetermined frequency range.

8 Claims, 8 Drawing Sheets

(51) Int. Cl.

| | |
|---|---|
| ***G10L 25/18*** | (2013.01) |
| *G10L 25/84* | (2013.01) |
| *G10L 25/81* | (2013.01) |

(56) References Cited

U.S. PATENT DOCUMENTS

| | | | | |
|---|---|---|---|---|
| 6,545,612 | B1 * | 4/2003 | Lindgren | H04M 1/0202 340/686.6 |
| 7,043,030 | B1 * | 5/2006 | Furuta | G10L 21/0208 381/94.1 |
| 7,337,107 | B2 | 2/2008 | Rose | |
| 2005/0201204 | A1 | 9/2005 | Dedieu | |
| 2007/0027681 | A1 | 2/2007 | Kim | |
| 2007/0174049 | A1 * | 7/2007 | Oh | G10L 25/90 704/207 |
| 2007/0288232 | A1 | 12/2007 | Kim | |
| 2009/0043577 | A1 * | 2/2009 | Godavarti | G10L 21/02 704/233 |
| 2009/0226010 | A1 | 9/2009 | Schnell | |
| 2010/0142732 | A1 | 6/2010 | Craven | |
| 2011/0286618 | A1 * | 11/2011 | Vandali | A61N 1/36032 381/320 |
| 2012/0140937 | A1 * | 6/2012 | Poe | H04R 3/02 381/60 |
| 2013/0151244 | A1 * | 6/2013 | Chen | G10L 25/69 704/205 |
| 2015/0032447 | A1 * | 1/2015 | Gunawan | G10L 25/84 704/233 |

OTHER PUBLICATIONS

Xuejing Sun "A Pitch Determination Algorithm Based on Subharmonic-to-harmonic Ratio", the 6th International Conference of Spoken Language Processing, 2000, pp. 676-679.*

Xuejing Sun "Pitch Determination and Voice Quality Analysis Using Subharmonic-to-harmonic ratio" ICASSP 2002 pp. 333-336.*

Drugman et al ("Joint Robust Voicing Detection and Pitch Estimation based on Residual Harmonics" INTERSPEECH Aug. 2011, Florence, Italy, pp. 1973-1976).*

Sun ("A Pitch Determination Algorithm Based on Subharmonic-to-harmonic Ratio", the 6th International Conference of Spoken Language Processing, 2000, pp. 676-679).*

Arturo Camacho, "Swipe: A Sawtooth Waveform Inspired Pitch Estimator for Speech and Music," Dec. 31, 2007, pp. 1-46, http://www.kerwa.ucr.ac.cr/bitstream/handle/10669/536/disseration.pdf?sequence=1, May 21, 2013.

Xuejing Sun, "A Pitch Determination Algorithm Based on Subharmonic-to-Harmonic Ratio," Department of Communication Sciences and Disorders, Northwestern University, pp. 1-4, Oct. 16, 2000.

Xuejing Sun, "Pitch Determination and Voice Quality Analysis Using Subharmonic-to-Harmonic Ratio," Acoustic, Speech, and Signal Processing (ICASSP) 2002 IEEE International Conference, pp. 1-333-1-336, May 13-17, 2002.

M. R. Schroeder, "Period Histogram and Product Spectrum: New Methods for Fundamental-Frequency Measurement," Acoustical Society of America Journal, 1968, vol. 43, Issue 4, pp. 829-834, Jan. 5, 1968.

D. J. Hermes, "Measurement of Pitch by Subharmonic Summation," J. Acoustic. Society, Am., vol. 83, pp. 257-264, 1988.

X. Sun et al., "Robust Noise Estimation Using Minimum Correction with Harmonicity Control," Interspeech, Makuhari, Japan, 2010.

L. Daudet and M. Sandler, "MDCT Analysis of Sinusoids: Exact Results and Applications to Coding Artifacts Reduction," IEEE Transactions on Speech and Audio Processing, vol. ASSP-12, No. 3, pp. 302-312, May 2004.

H. Kameoka, "A Multipitch Analyzer Based on Harmonic Temporal Structured Clustering," IEEE Transactions on Audio, Speech, and Language Processing, vol. 15, No. 3, Mar. 2007.

Anssi Klapuri, "Multiple Fundamental Frequency Estimation by Summing Harmonic Amplitudes," Institute of Signal Processing, Tampere University of technology, 2006.

Dongmei Wang and Qinghua Huang, "Single Channel Music Source Separation Based on Harmonic Structure Estimation," Circuits and Systems, 2009, ISCAS IEEE International Symposium, pp. 848-851, May 24-27, 2009.

H. Fujihara et al., "F0 Estimation Method for Singing Voice in Polyphonic Audio Signal Based on Statistical Vocal Model and Viterbi Search," Acoustics, Speech and Signal Processing, 2006, ICASSP, May 14-19, 2006.

E. Vincent et al., "Adaptive Harmonic Spectral Decomposition for Multiple Pitch Estimation," IEEE Transactions on Audio, Speech, and Language Processing, pp. 528-537, Oct. 9, 2009.

S. Srinivasan and D. Wang, "Robust Speech Recognition by Integrating Speech Separation and Hypothesis Testing," Journal of Speech Communication Archive, vol. 52, Issue 1, pp. 89-92, Mar. 18-23, 2005.

T Nakatani et al., "A Method for Fundamental Frequency Estimation and Voicing Decision: Application to Infant Utterances Recorded in Real Acoustical Environments," Journal of Speech Communications Archive, vol. 50, Issue 30, pp. 203-214, Mar. 2008.

Freund, Y. et al "A Decision-Theoretic Generalization of On-line Learning and an Application to Boosting" Sep. 20, 1995, pp. 1-34.

Scholkopf, B. et al "Learning with Kernels: Support Vector Machines, Regularization, Optimization, and Beyond", Cambridge, MA, MIT Press, 2001.

Hardcastle, W.J. et al "The Handbook of Phonetic Sciences" Wiley, 1999.

Qi, Yingyong "Temporal and Spectral Estimations of Harmonics-to-Noise Ratio in Human Voice Signals" J. Acoust. Soc. Am, Jul. 1997, pp. 537-543.

Lin, Z. et al "Instant Noise Estimation Using Fourier Transform of AMDF and Variable Start Minima Search" IEEE International Conference on Acoustics, Speech, and Signal Processing, vol. 1, Mar. 18-23, 2005, pp. 161-164.

Murphy, P. et al "Noise Estimation in Voice Signals Using Short-Term Cepstral Analysis" J. Acoustical Soc. AM, Mar. 2007, pp. 1679-1690.

Shue, Yen-Liang, et al "Voicesauce: A Program for Voice Analysis" Proc. of the 17th International Congress of Phonetic Sciences, vol. 3 of 3, Aug. 17-21, 2011, pp. 1846-1849, Hong Kong.

ISO/IEC JTC 1/SC 29 "Text of ISO/IEC FDIS 15938-4 Information Technology—Multimedia Content Description Interface Part 4: Audio" MPEG Meeting Jul. 2001.

Lu, G. et al "A Technique Towards Automatic Audio Classification and Retrieval" Signal Processing Proceedings, Fourth International Conference on Beijing, China, Oct. 12-16, 1998, pp. 1142-1145.

Chen, L. et al "Mixed Type Audio Classification with Support Vector Machine" IEEE International Conference on Multimedia and Expo, Jul. 9-12, 2006, pp. 781-784.

* cited by examiner

HARMONICITY ESTIMATION, AUDIO CLASSIFICATION, PITCH DETERMINATION AND NOISE ESTIMATION

CROSS-REFERENCE TO RELATED APPLICATIONS

This invention claims priority to Chinese patent application No. 201210080255.4 filed 23 Mar. 2012 and U.S. Provisional Patent Application No. 61/619,219 filed 2 Apr. 2012, which are hereby incorporated by reference in their entirety.

TECHNICAL FIELD

The present invention relates generally to audio signal processing. More specifically, embodiments of the present invention relate to harmonicity estimation, audio classification, pitch determination, and noise estimation.

BACKGROUND

Harmonicity represents the degree of acoustic periodicity of an audio signal, which is an important metric for many speech processing tasks. For example, it has been used to measure voice quality (Xuejing Sun, "Pitch determination and voice quality analysis using subharmonic-to-harmonic ratio," ICASSP 2002). It has also been used for voice activity detection and noise estimation. For example, in Sun, X., K. Yen, et al., "Robust Noise Estimation Using Minimum Correction with Harmonicity Control," Interspeech. Makuhari, Japan, 2010, a solution is proposed, where harmonicity is used to control minimum search such that a noise tracker is more robust to edge cases such as extended period of voicing and sudden jump of noise floor.

Various approaches have been proposed to measure the harmonicity. For example, one of the approaches is called Harmonics-to-Noise Ratio (HNR). Another approach, Subharmonic-to-Harmonic Ratio (SHR) has been proposed to describe the amplitude ratio between subharmonics and harmonics (Xuejing Sun, "Pitch determination and voice quality analysis using subharmonic-to-harmonic ratio," ICASSP 2002), where the pitch and SHR is estimated through shifting and summing linear amplitude spectra on logarithmic frequency scale.

In the previous approach for estimating SHR, the calculation is performed in the linear amplitude domain, where the large dynamic range could lead to instability due to numerical issues. The linear amplitude also limits the contribution from high frequency components, which are known to be important perceptually and crucial for classification of many high frequency rich audio content. Furthermore, an approximation has been used in the original approach (Sun, 2002) to calculate the subharmonic-to-harmonic ratio (otherwise a direct division in the linear domain, causing numerical issues, has to be used), which leads to inaccurate results.

SUMMARY

Embodiments of the invention include an alternative method to calculate SHR in the logarithmic spectrum domain. Moreover, embodiments of the invention also include extensions to SHR calculation for audio classification, noise estimation, and multi-pitch tracking.

According to an embodiment of the invention, a method of measuring harmonicity of an audio signal is provided.

According to the method, a log amplitude spectrum of the audio signal is calculated. A first spectrum is derived by calculating each component of the first spectrum as a sum of components of the log amplitude spectrum on frequencies. In linear frequency scale, the frequencies are odd multiples of the component's frequency of the first spectrum. A second spectrum is derived by calculating each component of the second spectrum as a sum of components of the log amplitude spectrum on frequencies. In linear frequency scale, the frequencies are even multiples of the component's frequency of the second spectrum. A difference spectrum is derived by subtracting the first spectrum from the second spectrum. A measure of harmonicity is generated as a monotonically increasing function of the maximum component of the difference spectrum within a predetermined frequency range.

According to an embodiment of the invention, an apparatus for measuring harmonicity of an audio signal is provided. The apparatus includes a first spectrum generator, a second spectrum generator, and a harmonicity estimator. The first spectrum generator calculates a log amplitude spectrum of the audio signal. The second spectrum generator derives a first spectrum by calculating each component of the first spectrum as a sum of components of the log amplitude spectrum on frequencies. In linear frequency scale, the frequencies are odd multiples of the component's frequency of the first spectrum. The second spectrum generator also derives a second spectrum by calculating each component of the second spectrum as a sum of components of the log amplitude spectrum on frequencies. In linear frequency scale, the frequencies are even multiples of the component's frequency of the second spectrum. The second spectrum generator also derives a difference spectrum by subtracting the first spectrum from the second spectrum. The harmonicity estimator generates a measure of harmonicity as a monotonically increasing function of the maximum component of the difference spectrum within a predetermined frequency range.

According to an embodiment of the invention, a method of classifying an audio signal is provided. According to the method, one or more features are extracted from the audio signal. The audio signal is classified according to the extracted features. For extraction of the features, at least two measures of harmonicity of the audio signal are generated based on frequency ranges defined by different expected maximum frequency. One of the features is calculated as a difference or a ratio between the harmonicity measures. The generation of each harmonicity measure based on a frequency range may be performed according to the method of measuring harmonicity.

According to an embodiment of the invention, an apparatus for classifying an audio signal is provided. The apparatus includes a feature extractor and a classifying unit. The feature extractor extracts one or more features from the audio signal. The classifying unit classifies the audio signal according to the extracted features. The feature extractor includes a harmonicity estimator and a feature calculator. The harmonicity estimator generates at least two measures of harmonicity of the audio signal based on frequency ranges defined by different expected maximum frequencies. The feature calculator calculates one of the features as a difference or a ratio between the harmonicity measures. The harmonicity estimator may be implemented as the apparatus for measuring harmonicity.

According to an embodiment of the invention, a method of generating an audio signal classifier is provided. According to the method, a feature vector including one or more features is extracted from each of sample audio signals. The audio signal classifier is trained based on the feature vectors. For the extraction of the features from the sample audio signal, at least two measures of harmonicity of the sample audio signal are generated based on frequency ranges defined by different expected maximum frequencies. One of the features is calculated as a difference or a ratio between the harmonicity measures. The generation of each harmonicity measure based on a frequency range may be performed according to the method of measuring harmonicity.

According to an embodiment of the invention, an apparatus for generating an audio signal classifier is provided. The apparatus includes a feature vector extractor and a training unit. The feature vector extractor extracts a feature vector including one or more features from each of sample audio signals. The training unit trains the audio signal classifier based on the feature vectors. The feature vector extractor includes a harmonicity estimator and a feature calculator. The harmonicity estimator generates at least two measures of harmonicity of the sample audio signal based on frequency ranges defined by different expected maximum frequencies. The feature calculator calculates one of the features as a difference or a ratio between the harmonicity measures. The harmonicity estimator may be implemented as the apparatus for measuring harmonicity.

According to an embodiment of the invention, a method of performing pitch determination on an audio signal is provided. According to the method, a log amplitude spectrum of the audio signal is calculated. A first spectrum is derived by calculating each component of the first spectrum as a sum of components of the log amplitude spectrum on frequencies. In linear frequency scale, the frequencies are odd multiples of the component's frequency of the first spectrum. A second spectrum is derived by calculating each component of the second spectrum as a sum of components of the log amplitude spectrum on frequencies. In linear frequency scale, the frequencies are even multiples of the component's frequency of the second spectrum. A difference spectrum is derived by subtracting the first spectrum from the second spectrum. One or more peaks above a threshold level are identified in the difference spectrum. Pitches in the audio signal are determined as doubles of frequencies of the peaks.

According to an embodiment of the invention, an apparatus for performing pitch determination on an audio signal is provided. The apparatus includes a first spectrum generator, a second spectrum generator, and a pitch identifying unit. The first spectrum generator calculates a log amplitude spectrum of the audio signal. The second spectrum generator derives a first spectrum by calculating each component of the first spectrum as a sum of components of the log amplitude spectrum on frequencies. In linear frequency scale, the frequencies are odd multiples of the component's frequency of the first spectrum. The second spectrum generator also derives a second spectrum by calculating each component of the second spectrum as a sum of components of the log amplitude spectrum on frequencies. In linear frequency scale, the frequencies are even multiples of the component's frequency of the second spectrum. The second spectrum generator also derives a difference spectrum by subtracting the first spectrum from the second spectrum. The pitch identifying unit identifies one or more peaks above a threshold level in the difference spectrum, and determines pitches in the audio signal as doubles of frequencies of the peaks.

According to an embodiment of the invention, a method of performing noise estimation on an audio signal is provided. According to the method, a speech absence probability q(k,t) is calculated, where k is a frequency index and t is a time index. An improved speech absence probability UV(k,t) is calculated as below $$UV(k, t) = \frac{1 - h(t)}{q(k, t)(1 - h(t)) + 1 - q(k, t)},$$

where h(t) is a harmonicity measure at time t. A noise power $P_N(k,t)$ is estimated by using the improved speech absence probability UV(k,t). For the calculation of the improved speech absence probability UV(k,t), the harmonicity measure h(t) is generated according to the method of measuring harmonicity.

According to an embodiment of the invention, an apparatus for performing noise estimation on an audio signal is provided. The apparatus includes a speech estimating unit, a noise estimating unit and a harmonicity measuring unit. The speech estimating unit calculates a speech absence probability q(k,t) where k is a frequency index and t is a time index The speech estimating unit also calculates an improved speech absence probability UV(k,t) as below $$UV(k, t) = \frac{1 - h(t)}{q(k, t)(1 - h(t)) + 1 - q(k, t)},$$

where h(t) is a harmonicity measure at time t. The noise estimating unit estimates a noise power $P_N(k,t)$ by using the improved speech absence probability UV(k,t). The harmonicity measuring unit includes the apparatus for measuring harmonicity h(t).

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF DRAWINGS

The present invention is illustrated by way of example, and not by way of limitation, in the figures of the accompanying drawings and in which like reference numerals refer to similar elements and in which.

DETAILED DESCRIPTION

Figure 1:
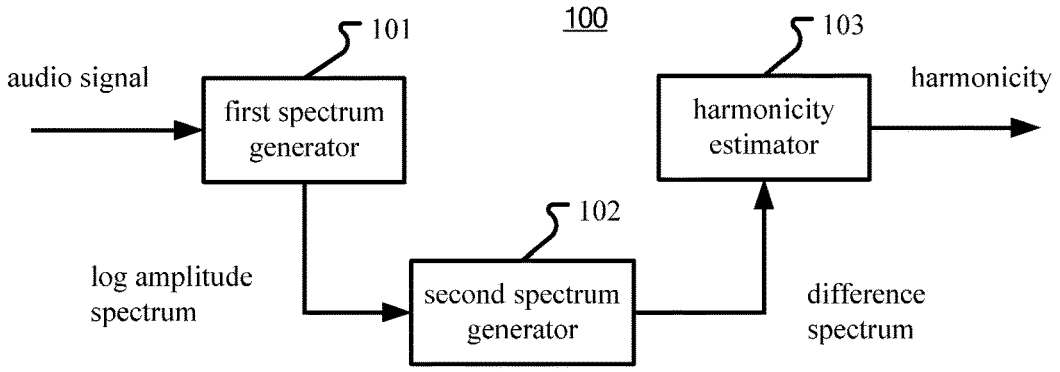
FIG. 1 is a block diagram illustrating an example apparatus for measuring harmonicity of an audio signal according to an embodiment of the invention.

The embodiments of the present invention are below described by referring to the drawings. It is to be noted that, for purpose of clarity, representations and descriptions about those components and processes known by those skilled in the art but not necessary to understand the present invention are omitted in the drawings and the description.

As will be appreciated by one skilled in the art, aspects of the present invention may be embodied as a system, a device (e.g., a cellular telephone, portable media player, personal computer, television set-top box, or digital video recorder, or any media player), a method or a computer program product. Accordingly, aspects of the present invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof.

A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wired line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Harmonicity Estimation

FIG. 1 is a block diagram illustrating an example apparatus 100 for measuring harmonicity of an audio signal according to an embodiment of the invention.

As illustrated in FIG. 1, the apparatus 100 includes a first spectrum generator 101, a second spectrum generator 102 and a harmonicity estimator 103.

The first spectrum generator 101 is configured to calculate a log amplitude spectrum LX=log(|X|) of the audio signal, where X is the frequency spectrum of the audio signal. It can be understood that the frequency spectrum can be derived through any applicable time-frequency transformation techniques, including Fast Fourier transform (FFT), Modified discrete cosine transform (MDCT), Quadrature mirror filter (QMF) bank, and so forth. With the log transformation, the spectrum is not limited to amplitude spectrum, and higher order spectrum such as power or cubic can be used here as well. Also, it can be understood that the base for the logarithmic transform do not have significant impact on the results. For convenience, base 10 may be selected, which corresponds to the most common setting for representing the spectrum in dB scale in human perception.

The second spectrum generator 102 is configured to derive a first spectrum (log sum of subharmonics) (LSS) by calculating each component LSS(f) at frequency (e.g., subband or frequency bin) f as a sum of components LX(f), LX(3f), . . . , LX((2n−1)f) on frequencies f, 3f, . . . , (2n−1)f. Note that in the original SHR algorithm (Sun, 2002), SS is used to denote the sum of subharmonics in the linear amplitude domain. Here we use LSS to denote the sum of the subharmonics in the log amplitude domain, which essentially corresponds to the product of the subharmonics in the original linear domain. In linear frequency scale, these frequencies are odd multiples of frequency f. The second spectrum generator 102 is also configured to derive a second spectrum LSH by calculating each component LSH(f) at frequency f as a sum of components LX(2f), LX(4f), . . . LX(2nf) on frequencies 2f, 4f, . . . , 2nf. In linear frequency scale, these frequencies are even multiples of frequency f. The value of n may be set as desired, as long as 2nf does not exceed the upper limit of the frequency range of the log amplitude spectrum.

In an example, the second spectrum generator 102 may derive the first spectrum LSS(f) and the second spectrum LSH(f) as follows:

$$LSS(f) = \sum_{n=1}^{N} LX((2n-1)f), \tag{1}$$

$$LSH(f) = \sum_{n=1}^{N} LX(2nf), \tag{2}$$

where N is the maximum number of harmonics and of subharmonics to be considered in measuring the harmonicity. N may be set as desired. As an example, N is determined by expected maximum frequency $f_{max}$ and expected minimum pitch $f_{0,min}$ as below $$N = \left\lfloor \frac{f_{max}}{f_{0,min}} \right\rfloor.$$

In this way, N can cover all the harmonics and subharmonics to be considered. It is possible to set LX(f)=C where C is a constant, e.g. 0, if f exceeds the upper limit of the frequency range of the log amplitude spectrum. Therefore, the frequency range of LSS and LSH is not limited. Alternatively, N can be adaptive according to signal content or/and complexity requirement. This can be realized by dynamically adjusting $f_{max}$ to cover more or less frequency range. Alternatively, N can be adjusted if the minimum pitch is known a priori. Alternatively, a value smaller than N can be used in Eqs. (1) and (2), for example $$LSS(f) = \sum_{n=1}^{N/2} LX((2n-1)f) \tag{1'}$$

$$LSH(f) = \sum_{n=1}^{N/2} LX(2nf) \tag{2'}$$

The second spectrum generator 102 is further configured to derive a difference spectrum, which corresponds to harmonic-to-subharmonic ratio (HSR) in the linear amplitude domain, by subtracting the first spectrum LSS from the second spectrum LSH, that is, HSR=LSH-LSS. In the example of equations (1) and (2), the difference spectrum HSR may be derived as below $$HSR(f) = \sum_{n=1}^{N} (\log|X(2nf)| - \log|X((2n-1)f)|). \tag{3}$$

The harmonicity estimator 103 is configured to generate a measure of harmonicity H as a monotonically increasing function F( ) of the maximum component $HSR_{max}$ of the difference spectrum HSR within a predetermined frequency range. Harmonicity represents the degree of acoustic periodicity of an audio signal. The difference spectrum HSR represents a ratio of harmonic amplitude to subharmonic amplitude or difference in the log spectrum domain at different frequencies. Alternatively, it can be viewed as a representation of peak-to-valley ratio of the original linear spectrum, or peak-to-valley difference in the log spectrum domain. If HSR(f) at frequency f is higher, it is more likely that there are harmonics with the fundamental frequency 2f. The higher HSR(f) is, the more dominant the harmonics are. Therefore, the maximum component of the difference spectrum HSR may be used to derive a measure to represent the harmonicity of the audio signal and its location can be used to estimate pitch. There is a monotonically increasing function relation between the measure H and the maximum component $HSR_{max}$. This means if there are $HSR_{max1} \leq HSR_{max2}$, then $H1=F(HSR_{max1}) \leq H2=F(HSR_{max2})$. In an example, the measure H may be directly equal to $HSR_{max}$.

The predetermined frequency range may be dependent on the class of periodical signals which the harmonicity measure intends to cover. For example, if the class is speech or voice, the predetermined frequency range corresponds to normal human pitch range. An example range is 70 Hz-450 Hz. In the example of HSR defined in (3), assuming the normal human pitch range as $[f_{0,min}, f_{0,max}]$, the predetermined frequency range is $[0.5f_{0,min}, 0.5f_{0,max}]$.

According the embodiments of the invention, calculating HSR in the logarithmic spectrum domain can address the aforementioned problems associated with the prior art method. Therefore, more accurate harmonicity estimation can be achieved.

Figure 2:
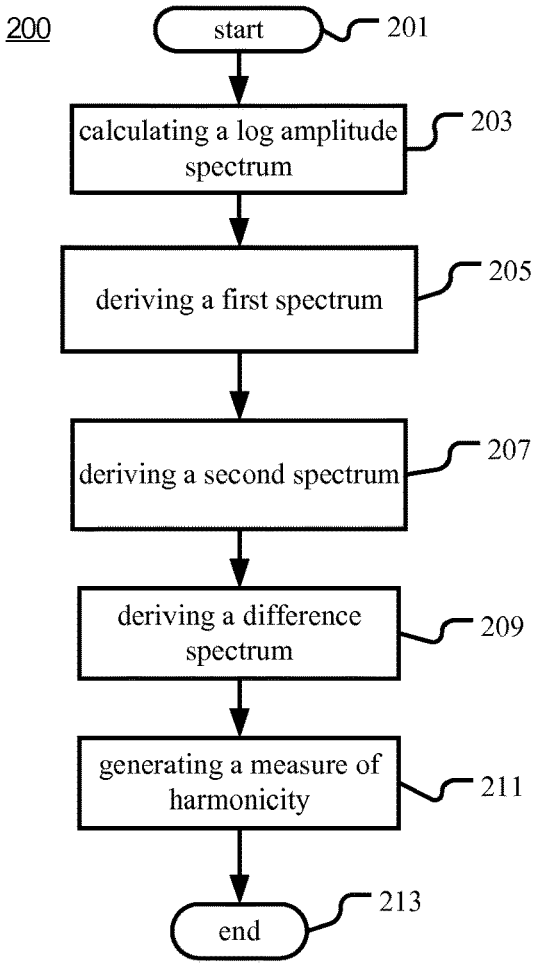
FIG. 2 is a flow chart illustrating an example method of measuring harmonicity of an audio signal according to an embodiment of the invention.

FIG. 2 is a flow chart illustrating an example method 200 of measuring harmonicity of an audio signal according to an embodiment of the invention.

As illustrated in FIG. 2, the method 200 starts from step 201. At step 203, a log amplitude spectrum LX=log(|X|) of the audio signal is calculated, where X is the frequency spectrum of the audio signal.

At step 205, a first spectrum LSS is derived by calculating each component LSS(f) at frequency (e.g., subband or frequency bin) f as a sum of components LX(f), LX(3f), . . . , LX((2n−1)f) on frequencies f, 3f, . . . , (2n−1)f. In linear frequency scale, these frequencies are odd multiples of frequency f.

At step 207, a second spectrum LSH is derived by calculating each component LSH(f) at frequency f as a sum of components LX(2f), LX(4f), . . . LX(2nf) on frequencies 2f, 4f, . . . , 2nf. In linear frequency scale, these frequencies are even multiples of frequency f.

At step 209, a difference spectrum HSR is derived by subtracting the first spectrum LSS from the second spectrum LSH, that is, HSR=LSH−LSS.

At step 211, a measure of harmonicity H is generated as a monotonically increasing function F( ) of the maximum component $HSR_{max}$ of the difference spectrum HSR within a predetermined frequency range. The predetermined frequency range may be dependent on the class of periodical signals which the harmonicity measure intends to cover. For example, if the class is speech or voice, the predetermined frequency range corresponds to normal human pitch range. An example range is 70 Hz-450 Hz.

The method 200 ends at step 213.

In further embodiments of the apparatus 100 and the method 200, the calculation of the log amplitude spectrum may comprise transforming the log amplitude spectrum from linear frequency scale to log frequency scale. For example, the linear frequency scale may be transformed to the log frequency scale with $s=\log_2(f)$, and therefore, equation (3) becomes $$HSR(s) = \sum_{n=1}^{N} (\log|X(s+\log_2(2n)| - \log|X(s+\log_2(2n-1))|). \quad (3')$$

Thus spectrum compression on a linear frequency scale becomes spectrum shifting on a log frequency scale.

Further, it is possible to interpolate the transformed log amplitude spectrum along the frequency axis. Such an interpolation avoids the insufficient data sample issue in spectrum compression and oversampling the low frequency spectrum is also perceptually plausible. Preferably, the step size (minimum scale unit) for the interpolation is not smaller than a difference $\log_2(f(k_{max}))-\log_2(f(k_{max}-1))$ between frequencies in log frequency scale of the first highest frequency bin $k_{max}$ and the second highest frequency bin $k_{max}-1$ in linear frequency scale of the log amplitude spectrum.

Further, it is also possible to normalize the interpolated log amplitude spectrum through subtracting the interpolated log amplitude spectrum by its minimum component as below $$\log|X'(s')| = \log|X(s')| - \min(\log|X(s')|) \quad (4).$$

In this way, it is possible to reduce the impact of extreme small values.

In further embodiments of the apparatus 100 and the method 200, in the calculation of the log amplitude spectrum, it is possible to calculate an amplitude spectrum of the audio signal, and then weight the amplitude spectrum with a weighting vector to suppress an undesired component such as low frequency noise. Then the weighted amplitude spectrum is performed a logarithmic transform to obtain the log amplitude spectrum. In this way, it is possible to weigh the spectrum non-evenly. For example, to reduce the impact of low frequency noise, amplitude of low frequencies can be zeroed. This weighting vector can be pre-defined or dynamically estimated, according to the distribution of components which are desired to be suppressed. For example, we can use an energy-based speech presence probability estimator to generate a weighting vector dynamically for each audio frame. For example, to suppress the noise, the apparatus 100 may include a noise estimator configured to perform energy-based noise estimation for each frequency of the amplitude spectrum to generate a speech presence probability. The method 200 may include performing energy-based noise estimation for each frequency of the amplitude spectrum to generate a speech presence probability. The weighting vector may contain the generated speech presence probabilities.

Audio Classification

Figure 3:
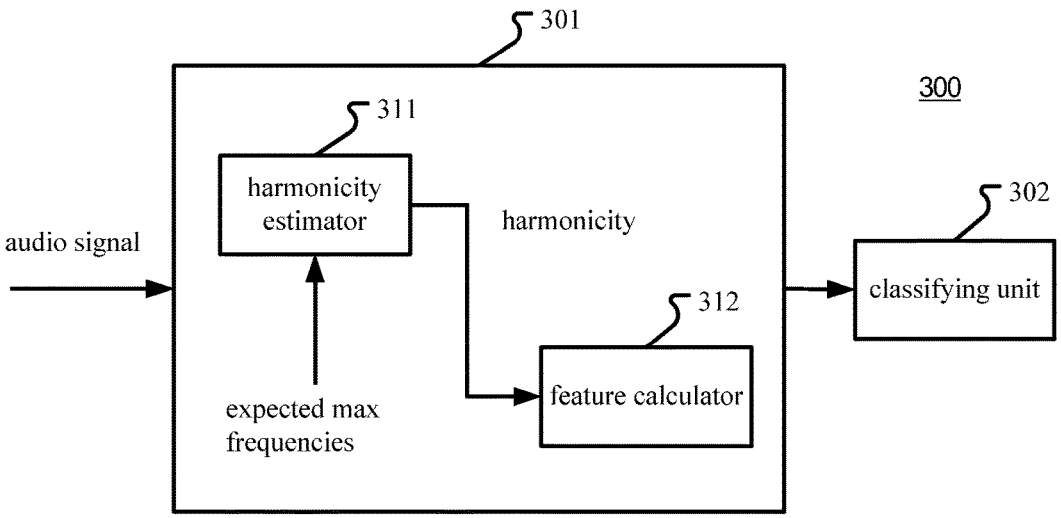
FIG. 3 is a block diagram illustrating an example apparatus for classifying an audio signal according to an embodiment of the invention.

FIG. 3 is a block diagram illustrating an example apparatus 300 for classifying an audio signal according to an embodiment of the invention.

As illustrated in FIG. 3, the apparatus 300 includes a feature extractor 301 and a classifying unit 302. The feature extractor 301 is configured to extract one or more features from the audio signal. The classifying unit 302 is configured to classify the audio signal according to the extracted features.

The feature extractor 301 may include a harmonicity estimator 311 and a feature calculator 312. The harmonicity estimator 311 is configured to generate at least two measures $H_1$ to $H_M$ of harmonicity of the audio signal based on frequency ranges defined by different expected maximum frequencies $f_{max1}$ to $f_{maxM}$. The harmonicity estimator 311 may be implemented with the apparatus 100 described in section "Harmonicity Estimation", except that the frequency range of the log amplitude spectrum may be changed for each harmonicity measure. In an example, there are three frequency ranges as below Setting 1: $f_{max}$=1250 Hz, $f_{0,min}$=75 Hz, $f_{0,max}$=450 Hz
Setting 2: $f_{max}$=3300 Hz, $f_{0,min}$=75 Hz, $f_{0,max}$=450 Hz
Setting 3: $f_{max}$=5000 Hz, $f_{0,min}$=75 Hz, $f_{0,max}$=450 Hz.

Harmonicity measure obtained based on Setting 1 is intended to characterize normal signals such as clean speech with just the first several harmonics. Harmonicity measure obtained based on Setting 2 is intended to characterize noisy signals such as speech including many color noises (e.g., car noise). Noise with significant energy concentration at low frequency regions will mask the harmonic structure of speech or other targeted audio signals, which renders Setting 1 ineffective for audio classification. Harmonicity measure obtained based on Setting 3 is intended to characterize music signals because abundant harmonics can exist at much higher frequencies. Depending on the signal type, varying $f_{max}$ can have significant impact on the harmonicity measure. The reason is that different signal types may have different harmonic structure and harmonicity distribution at different frequency regions. By varying the maximum spectral frequency, it is possible to characterize individual contributions from different frequency regions to the overall harmonicity.

Therefore, it is possible to use harmonicity difference or harmonicity ratio as an additional dimension for audio classification.

The feature calculator 312 is configured to calculate a difference, a ratio or both the difference and ratio between the harmonicity measures obtained by the harmonicity estimator 311 based on different frequency ranges, as a portion of the features extracted from the audio signal. In an example, let H1, H2 and H3 be the harmonicity measures obtained based on Setting 1, Setting 2 and Setting 3 respectively, then the calculated feature may include one or more of H2-H1, H3-H2, H2/H1 and H3/H2.

Figure 4:
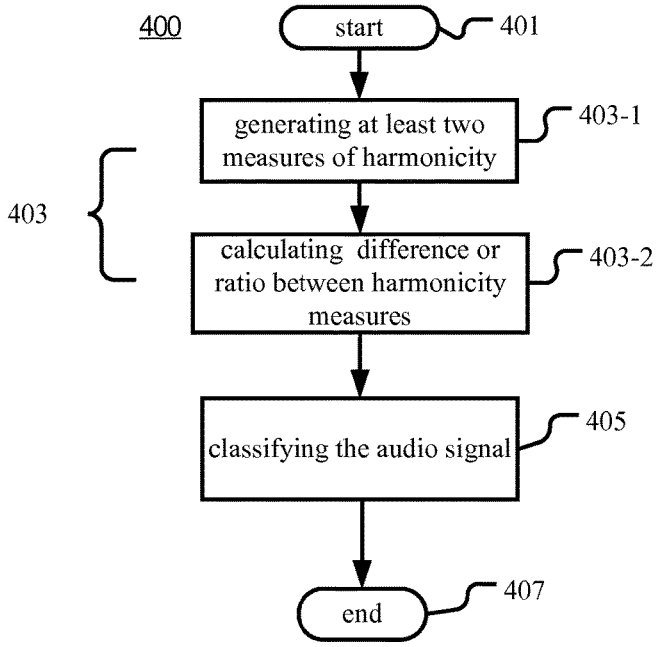
FIG. 4 is a flow chart illustrating an example method of classifying an audio signal according to an embodiment of the invention.

FIG. 4 is a flow chart illustrating an example method 400 of classifying an audio signal according to an embodiment of the invention.

As illustrated in FIG. 4, the method 400 starts from step 401. At step 403, one or more features are extracted from the audio signal. At step 405, the audio signal is classified according to the extracted features. The method ends at step 407.

The step 403 may include step 403-1 and step 403-2. At step 403-1, at least two measures $H_1$ to $H_M$ of harmonicity of the audio signal are generated based on frequency ranges defined by different expected maximum frequencies $f_{max1}$ to $f_{maxM}$. Each harmonicity measure may be obtained by executing the method 200 described in section "Harmonicity Estimation", except that the frequency range of the log amplitude spectrum may be changed for each harmonicity measure. At step 403-2, one or more of a difference, a ratio or both the difference and ratio between the harmonicity measures obtained at step 403-1 are calculated based on different frequency ranges, as a portion of the features extracted from the audio signal.

Figure 5:
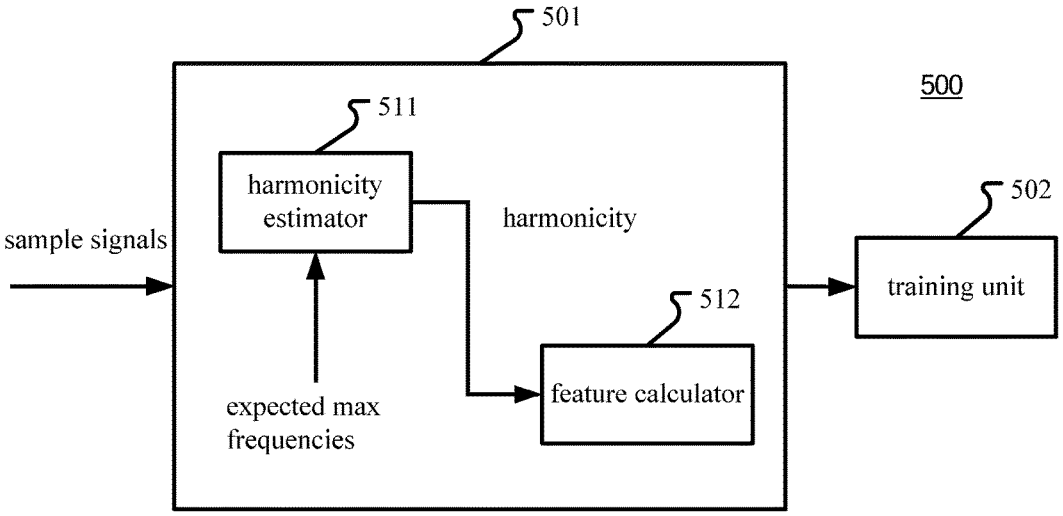
FIG. 5 is a block diagram illustrating an example apparatus for generating an audio signal classifier according to an embodiment of the invention.

FIG. 5 is a block diagram illustrating an example apparatus 500 for generating an audio signal classifier according to an embodiment of the invention.

As illustrated in FIG. 5, the apparatus 500 includes a feature extractor 501 and a training unit 502. The feature extractor 501 is configured to extract one or more features from each of sample audio signals. The feature extractor 501 may be implemented with the feature extractor 301 except that the feature extractor 501 extracts the features from different audio signals. In this case, the feature extractor 501 includes a harmonicity estimator 511 and a feature calculator 512, similar to the harmonicity estimator 311 and the feature calculator 312 respectively. The training unit 502 is configured to train the audio signal classifier based on the feature vectors extracted by the feature extractor 501.

Figure 6:
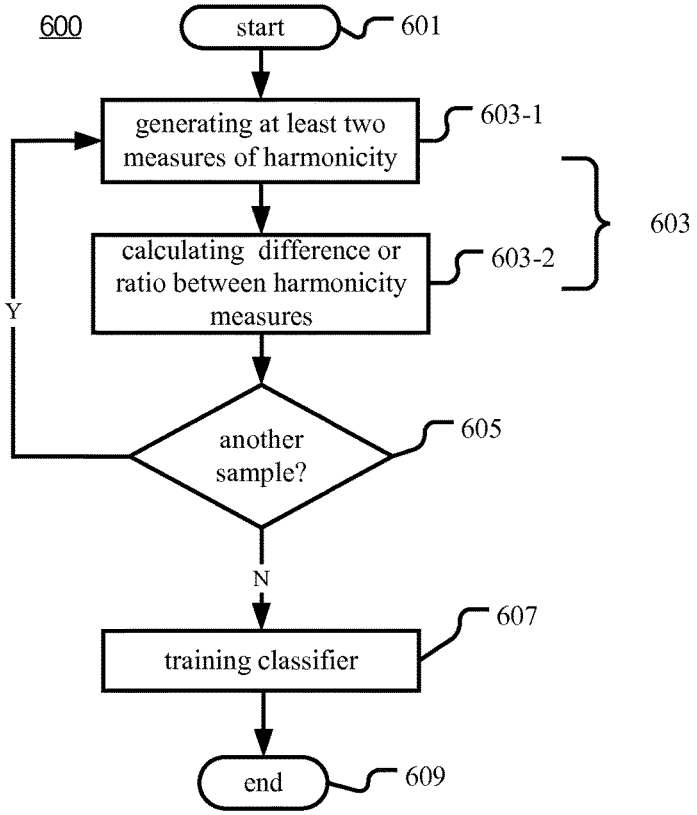
FIG. 6 is a flow chart illustrating an example method of generating an audio signal classifier according to an embodiment of the invention.

FIG. 6 is a flow chart illustrating an example method 600 of generating an audio signal classifier according to an embodiment of the invention.

As illustrated in FIG. 6, the method 600 starts from step 601. At step 603, one or more features are extracted from a sample audio signal. At step 605, it is determined whether there is another sample audio signal for feature extraction. If it is determined that there is another sample audio signal for feature extraction, the method 600 returns to step 605 to process the other sample audio signal. If otherwise, at step 607, an audio signal classifier is trained based on the feature vectors extracted at step 603. Step 603 has the same function as step 403, and is not described in detail here. The method ends at step 609.

Pitch Determination

Figure 7:
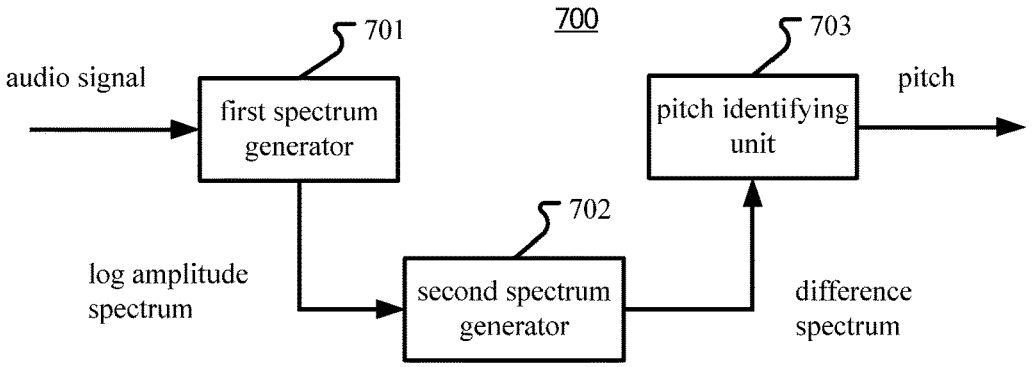
FIG. 7 is a block diagram illustrating an example apparatus for performing pitch determination on an audio signal according to an embodiment of the invention.

FIG. 7 is a block diagram illustrating an example apparatus 700 for performing pitch determination on an audio signal according to an embodiment of the invention.

As illustrated in FIG. 7, the apparatus 700 includes a first spectrum generator 701, a second spectrum generator 702 and a pitch identifying unit 703. The first spectrum generator 701 and the second spectrum generator 702 have the same function as the first spectrum generator 101 and the second spectrum generator 102 respectively, and are not described in detail here. The pitch identifying unit 703 is configured to identify one or more peaks above a threshold level in the difference spectrum, and determine frequencies of the peaks as pitches in the audio signal. The threshold level may be predefined or tuned according to the requirement on sensitivity.

Figure 9:
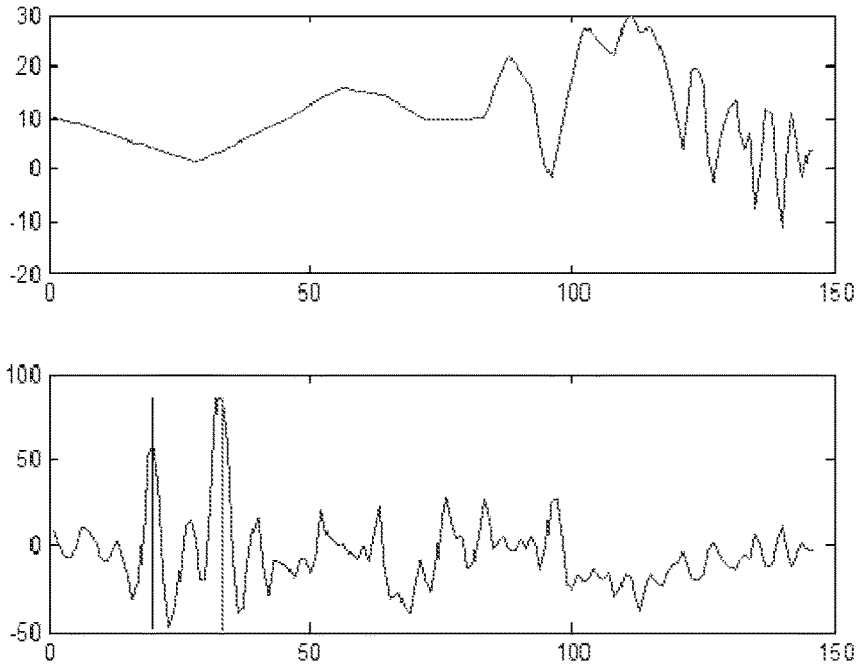
FIG. 9 is a diagram schematically illustrating peaks in a difference spectrum.

FIG. 9 is a diagram schematically illustrating peaks in a difference spectrum. In FIG. 9, the upper plot depicts one frame of interpolated log amplitude spectrum on log frequency scale. The time domain signal is generated by mixing two synthetic vowels, which are generated using Praat's VowelEditor with different F0s (100 Hz and 140 Hz). The bottom plot illustrates two pitch peaks marked with straight lines on the difference spectrum. The detected pitches are 140.5181 Hz and 101.1096 Hz, respectively.

It can be understood that this method of multi-pitch tracking only generates instantaneous pitch values at frame level. It is known that in order to generate reliable pitch tracks, inter-frame processing is required. The proposed method thus can always be combined together with well established post-processing algorithms, such as dynamic programming, or pitch track clustering, to further improve multi-pitch tracking performance.

It can be understood that although a pitch determination algorithm has been described, the previous SHR algorithm (Sun, 2002) does not reveal any multi-pitch tracking method, which is a vastly different problem. It is also not immediately clear how multiple pitches can be identified using the original approach.

Figure 8:
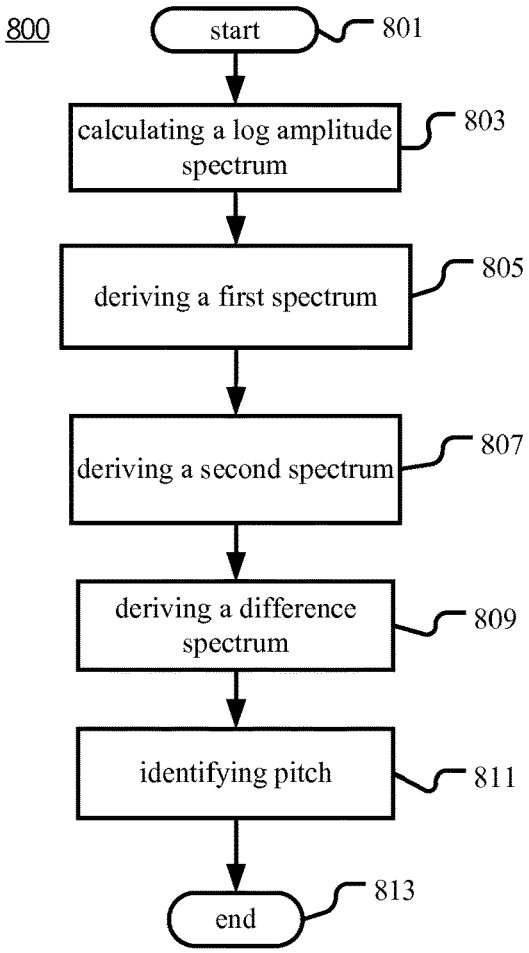
FIG. 8 is a flow chart illustrating an example method of performing pitch determination on an audio signal according to an embodiment of the invention.

FIG. 8 is a flow chart illustrating an example method 800 of performing pitch determination on an audio signal according to an embodiment of the invention.

In FIG. 8, steps 801, 803, 805, 807, 809 and 813 have the same functions as steps 201, 203, 205, 207, 209 and 213 respectively and are not described in detail here. After step 809, the method 800 proceeds to step 811. At step 811, one or more peaks above a threshold level are identified in the difference spectrum, and frequencies of the identified peaks are determined as pitches in the audio signal. The threshold level may be predefined or tuned according to the requirement on sensitivity.

Figure 10:
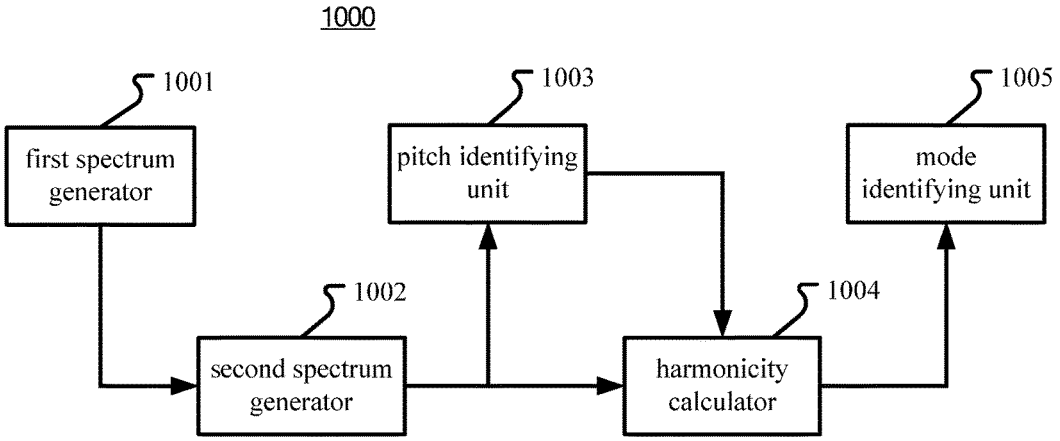
FIG. 10 is a block diagram illustrating an example apparatus for performing pitch determination on an audio signal according to an embodiment of the invention.

FIG. 10 is a block diagram illustrating an example apparatus 1000 for performing pitch determination on an audio signal according to an embodiment of the invention.

As illustrated in FIG. 10, the apparatus 1000 includes a first spectrum generator 1001, a second spectrum generator 1002, a pitch identifying unit 1003, a harmonicity calculator 1004 and a mode identifying unit 1005. The first spectrum generator 1001, the second spectrum generator 1002 and the pitch identifying unit 1003 have the same functions as the first spectrum generator 101, the second spectrum generator 102 and the pitch identifying unit 703 respectively, and are not described in detail here.

For each of the peaks identified by the pitch identifying unit 1003, the harmonicity calculator 1004 is configured to generating a measure of harmonicity as a monotonically increasing function of the peak's magnitude in the difference spectrum. The harmonicity calculator 1004 has the same function as the harmonicity estimator 103, except that the maximum component $HSR_{max}$ is replaced by the peak's magnitude. In an example, the measure H may be directly equal to the peak's magnitude.

The mode identifying unit 1005 is configured to identify the audio signal as an overlapping speech segment if the peaks include two peaks and their harmonicity measures fall within a predetermined range. The predetermined range may be determined based on the following observations. Let h1 and h2 represent harmonicity measures obtained with the method described in section "Harmonicity Estimation" respectively from two signals. Then the two signals are mixed into one signal, and the method 800 is executed on the mixed signal to identified two peaks. Through the method used by the harmonicity calculator 1004, harmonicity measures corresponding to the two peaks are calculated respectively. Let H1 and H2 represent the calculated harmonicity measures respectively. If it is found that 1) if h1 and h2 are low, H1 and H2 are low; 2) if h1 is high and h2 is low, H1 is high and H2 is low; 3) if h1 is low and h2 is high, H1 is low and H2 is high, and 4) if h1 is high and h2 is high, H1 is medium and H2 is medium. The predetermined range is used to identify the medium level, and may be determined based on statistics. Pattern 4) corresponds to overlapping (harmonic) speech segments, which occur often in audio conferences, such that different noise suppression modes can be deployed.

Figure 11:
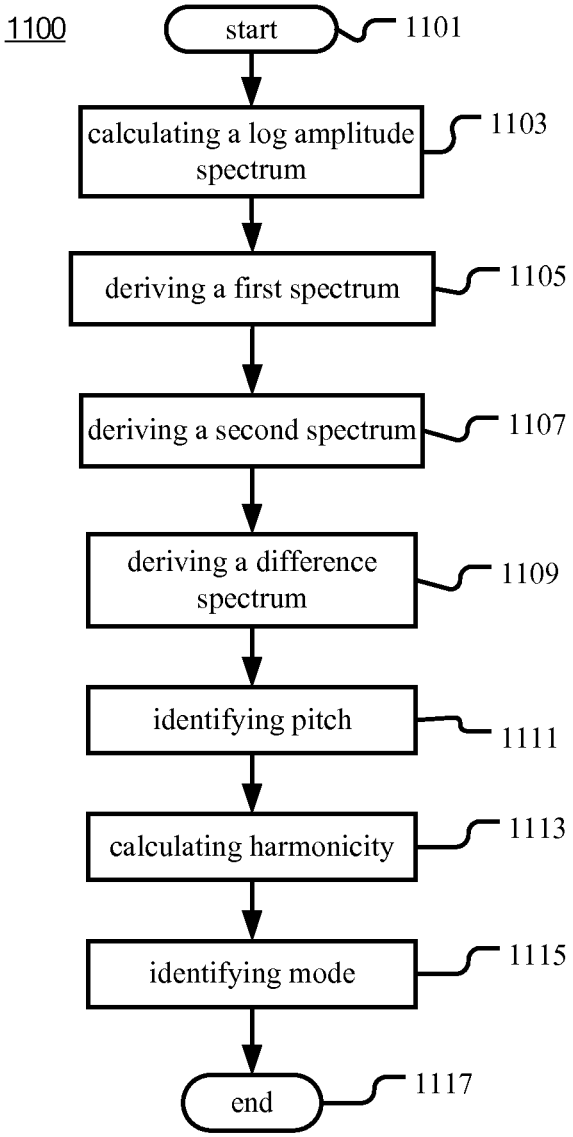
FIG. 11 is a flow chart illustrating an example method of performing pitch determination on an audio signal according to an embodiment of the invention.

FIG. 11 is a flow chart illustrating an example method 1100 of performing pitch determination on an audio signal according to an embodiment of the invention.

In FIG. 11, steps 1101, 1103, 1105, 1107, 1109, 1111 and 1117 have the same functions as steps 201, 203, 205, 207, 209, 811 and 213 respectively and are not described in detail here. After step 1111, the method 1100 proceeds to step 1113. At step 1113, for each of the peaks identified at step 1111, a measure of harmonicity is generated as a monotonically increasing function of the peak's magnitude in the difference spectrum. Each harmonicity measure may be generated with the same method as step 211, except that the maximum component $HSR_{max}$ is replaced by the peak's magnitude. In an example, the measure H may be directly equal to the peak's magnitude.

At step 1115, the audio signal is identified as an overlapping speech segment if the peaks include two peaks and their harmonicity measures fall within a predetermined range.

In further embodiments of the apparatus 1000 and the method 1100, the condition for identifying the audio signal as an overlapping speech segment include 1) the peaks include at least two peaks with the harmonicity measures falling within the predetermined range, and 2) with the harmonicity measures have magnitudes close to each other.

In further embodiments of the apparatus 1000 and the method 1100, in case of calculating the amplitude spectrum and then calculating the log spectrum of the amplitude spectrum, it is possible to perform a Modified Discrete Cosine Transform (MDCT) transform on the audio signal to generate a MDCT spectrum as an amplitude metric. Then, for more accurate harmonicity and pitch estimation, the MDCT spectrum is converted into a pseudo-spectrum according to $$S_k=((M_k)^2+(M_{k+1}-M_{k-1})^2)^{0.5},$$

before taking the normal log transform, where k is frequency bin index, and M is the MDCT coefficient.

Noise Estimation

Figure 12:
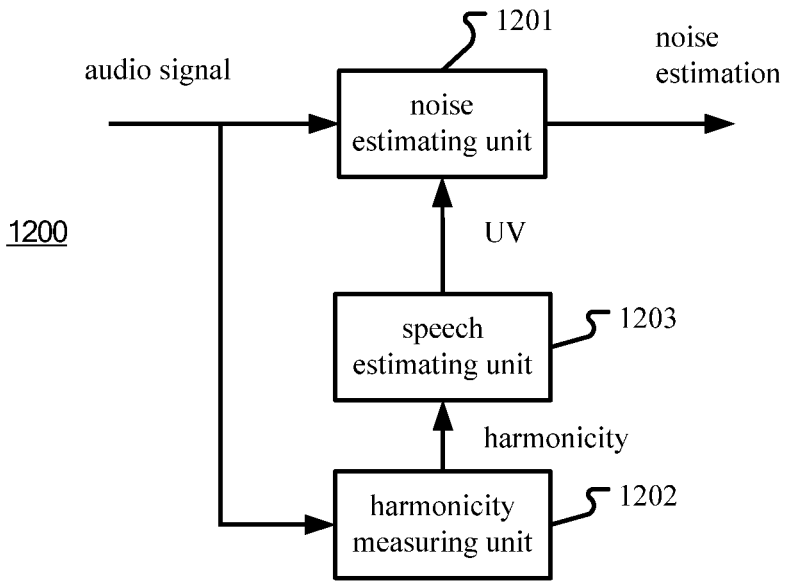
FIG. 12 is a block diagram illustrating an example apparatus for performing noise estimation on an audio signal according to an embodiment of the invention.

FIG. 12 is a block diagram illustrating an example apparatus 1200 for performing noise estimation on an audio signal according to an embodiment of the invention.

As illustrated in FIG. 12, the apparatus 1200 includes a noise estimating unit 1201, a harmonicity measuring unit 1202 and a speech estimating unit 1203.

The speech estimating unit 1203 is configured to calculate a speech absence probability q(k,t) where k is a frequency index and t is a time index, and calculate an improved speech absence probability UV(k,t) as below $$UV(k,t)=\frac{1-h(t)}{q(k,t)(1-h(t))+1-q(k,t)}, \tag{5}$$

where h(t) is a harmonicity measure at time t, and q(k,t) is the speech absence probability (SAP), $$q(k,t)=\frac{|X(k,t)|^2}{P_N(k,t-1)}\exp\left(1-\frac{|X(k,t)|^2}{P_N(k,t-1)}\right) \tag{6}$$

h(t) is measured by the harmonicity measuring unit 1202. The harmonicity measuring unit 1202 has the same function as the harmonicity estimator 103, and is not described in detail here.

The noise estimating unit 1201 is configured to estimate a noise power $P_N(k,t)$ by using the improved speech absence probability UV(k,t), instead of the speech absence probability q(k,t). In an example, the noise is estimated as below $$P_N(k,t)=P_N(k,t-1)+\alpha(k)UV(k,t)(|X(k,t)|^2-P_N(k,t-1)) \tag{7}$$

where $P_N(k,t)$ is the estimated noise power, $|X(k,t)|^2$ is the instantaneous noisy input power, $\alpha(k)$ is the time constant.

In this way, when q approaches 0 indicating a significant signal energy rise, its impact on the final value becomes small and harmonicity becomes the dominating factor. In the extreme case q=0, UV becomes 1-h. On the other hand, when q approaches 1 indicating a steady state signal, the final value is a combination of q and h.

Figure 13:
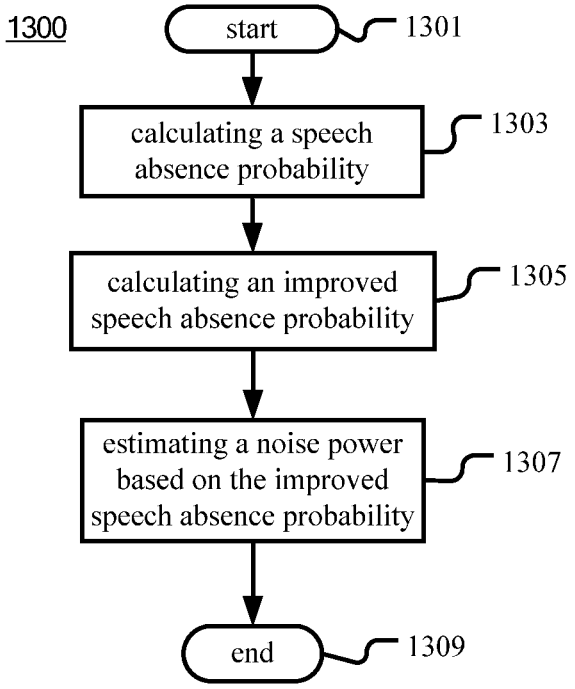
FIG. 13 is a flow chart illustrating an example method of performing noise estimation on an audio signal according to an embodiment of the invention.

FIG. 13 is a flow chart illustrating an example method 1300 of performing noise estimation on an audio signal according to an embodiment of the invention.

As illustrated in FIG. 13, the method 1300 starts from step 1301. At step 1303, a speech absence probability q(k,t) is calculated, where k is a frequency index and t is a time index. At step 1305, an improved speech absence probability UV(k,t) is calculated by using equation (5). At step 1307, a noise power $P_N(k,t)$ is estimated by using the improved speech absence probability UV(k,t), instead of the speech absence probability q(k,t). The method 1300 ends at step 1309. In the method 1300, h(t) may be calculated through the method 200.

Other Embodiments

In a further embodiment of the apparatus described in the above, the apparatus may be part of a mobile device and utilized in at least one of enhancing, managing, and communicating voice communications to and/or from the mobile device.

Further, results of the apparatus may be utilized to determine actual or estimated bandwidth requirements of the mobile device. In addition or alternatively, the results of the apparatus may be sent to a backend process in a wireless communication from the mobile device and utilized by the backend to manage at least one of bandwidth requirements of the mobile device and a connected application being utilized by, or being participated in via, the mobile device.

Further, the connected application may comprise at least one of a voice conferencing system and a gamming application. Further more, results of the apparatus may be utilized to manage functions of the gaming application. Further more, the managed functions may include at least one of player location identification, player movements, player actions, player options such as re-loading, player acknowledgements, pause or other controls, weapon selection, and view selection.

Further, results of the apparatus may be utilized to manage features of the voice conferencing system including any of remote controlled camera angles, view selections, microphone muting/unmuting, highlighting conference room participants or white boards, or other conference related or unrelated communications.

In a further embodiment of the apparatus described in the above, the apparatus may be operative to facilitate at least one of enhancing, managing, and communicating voice communications to and/or a mobile device.

In a further embodiment of the apparatus described in the above, the apparatus may be part of at least one of a base station, cellular carrier equipment, a cellular carrier backend, a node in a cellular system, a server, and a cloud based processor.

It should be noted that, the mobile device may comprise at least one of a cell phone, smart phone (including any i-phone version or android based devices), tablet computer (including i-Pad, galaxy, playbook, windows CE, or android based devices).

In a further embodiment of the apparatus described in the above, the apparatus may be part of at least one of a gaming system/application and a voice conferencing system utilizing the mobile device.

Figure 14:
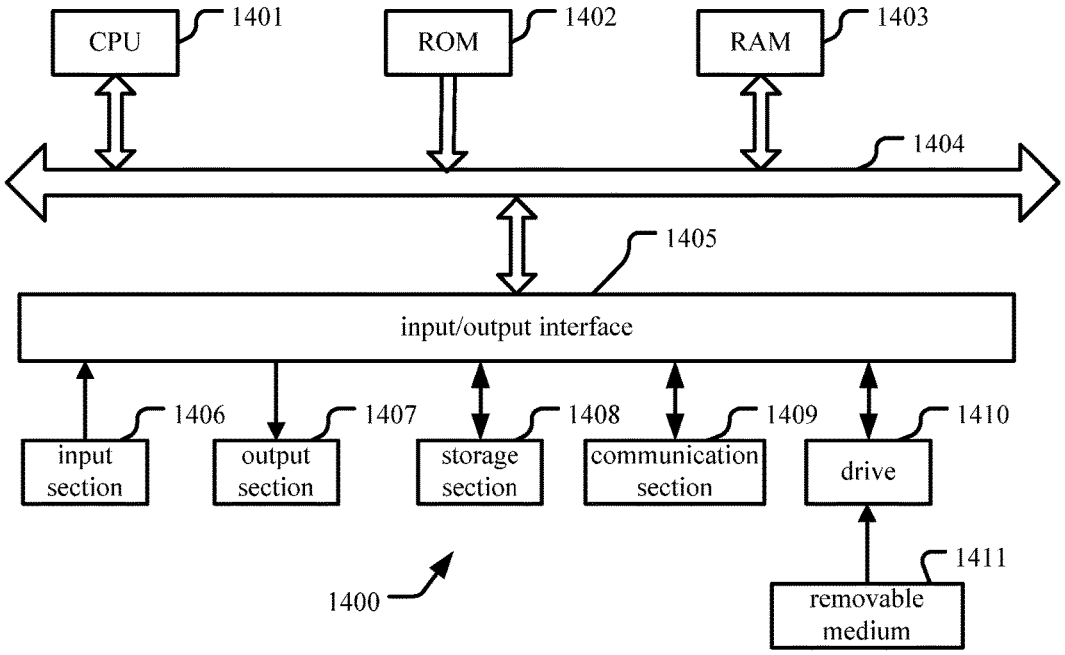
FIG. 14 is a block diagram illustrating an exemplary system for implementing embodiments of the present invention.

FIG. 14 is a block diagram illustrating an exemplary system 1400 for implementing embodiments of the present invention.

In FIG. 14, a central processing unit (CPU) 1401 performs various processes in accordance with a program stored in a read only memory (ROM) 1402 or a program loaded from a storage section 1408 to a random access memory (RAM) 1403. In the RAM 1403, data required when the CPU 1401 performs the various processes or the like are also stored as required.

The CPU 1401, the ROM 1402 and the RAM 1403 are connected to one another via a bus 1404. An input/output interface 1405 is also connected to the bus 1404.

The following components are connected to the input/output interface 1405: an input section 1406 including a keyboard, a mouse, or the like; an output section 1407 including a display such as a cathode ray tube (CRT), a liquid crystal display (LCD), or the like, and a loudspeaker or the like; the storage section 1408 including a hard disk or the like; and a communication section 1409 including a network interface card such as a LAN card, a modem, or the like. The communication section 1409 performs a communication process via the network such as the internet.

A drive 1410 is also connected to the input/output interface 1405 as required. A removable medium 1411, such as a magnetic disk, an optical disk, a magneto-optical disk, a semiconductor memory, or the like, is mounted on the drive 1410 as required, so that a computer program read therefrom is installed into the storage section 1408 as required.

In the case where the above-described steps and processes are implemented by the software, the program that constitutes the software is installed from the network such as the internet or the storage medium such as the removable medium 1411.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The following exemplary embodiments (each an "EE") are described.

EE1. A method of measuring harmonicity of an audio signal, comprising:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE 2. The method according to EE 1, wherein the calculation of the log amplitude spectrum comprises transforming the log amplitude spectrum from linear frequency scale to log frequency scale.

EE 3. The method according to EE 2, wherein the calculation of the log amplitude spectrum further comprises interpolating the transformed log amplitude spectrum along the frequency axis.

EE 4. The method according to EE 3, wherein the interpolation is performed based on a step size not smaller than a difference between frequencies in log frequency scale of the first highest frequency bin and the second highest frequency bin in linear frequency scale of the log amplitude spectrum.

EE 5. The method according to EE 3, wherein the calculation of the log amplitude spectrum further comprises normalizing the interpolated log amplitude spectrum through subtracting the interpolated log amplitude spectrum by its minimum component.

EE 6. The method according to EE 1, wherein the predetermined frequency range corresponds to normal human pitch range.

EE 7. The method according to EE 1, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 8. The method according to EE 7, further comprising:

performing energy-based noise estimation for each frequency of the amplitude spectrum to generate a speech presence probability, and wherein the weighting vector contains the generated speech presence probabilities.

EE 9. An apparatus for measuring harmonicity of an audio signal, comprising:

a first spectrum generator configured to calculate a log amplitude spectrum of the audio signal;

a second spectrum generator configured to derive a first spectrum by calculating each component of the first spectrum as a sum of components of the log amplitude spectrum on frequencies which, in linear frequency scale, are odd multiples of the component's frequency of the first spectrum;

derive a second spectrum by calculating each component of the second spectrum as a sum of components of the log amplitude spectrum on frequencies which, in linear frequency scale, are even multiples of the component's frequency of the second spectrum; and derive a difference spectrum by subtracting the first spectrum from the second spectrum; and a harmonicity estimator configured to generate a measure of harmonicity as a monotonically increasing function of the maximum component of the difference spectrum within a predetermined frequency range.

EE 10. The apparatus according to EE 9, wherein the calculation of the log amplitude spectrum comprises transforming the log amplitude spectrum from linear frequency scale to log frequency scale.

EE 11. The apparatus according to EE 10, wherein the calculation of the log amplitude spectrum further comprises interpolating the transformed log amplitude spectrum along the frequency axis.

EE 12. The apparatus according to EE 11, wherein the interpolation is performed based on a step size not smaller than a difference between frequencies in log frequency scale of the first highest frequency bin and the second highest frequency bin in linear frequency scale of the log amplitude spectrum.

EE 13. The apparatus according to EE 11, wherein the calculation of the log amplitude spectrum further comprises normalizing the interpolated log amplitude spectrum through subtracting the interpolated log amplitude spectrum by its minimum component.

EE 14. The apparatus according to EE 9, wherein the predetermined frequency range corresponds to normal human pitch range.

EE 15. The apparatus according to EE 9, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 16. The apparatus according to EE 15, further comprising:

a noise estimator configured to perform energy-based noise estimation for each frequency of the amplitude spectrum to generate a speech presence probability, and wherein the weighting vector contains the speech presence probabilities generated by the noise estimator.

EE 17. A method of classifying an audio signal, comprising:

extracting one or more features from the audio signal; and classifying the audio signal according to the extracted features, wherein the extraction of the features comprises:

generating at least two measures of harmonicity of the audio signal based on frequency ranges defined by different expected maximum frequencies; and calculating one of the features as a difference or a ratio between the harmonicity measures, wherein the generation of each harmonicity measure based on a frequency range comprises:

calculating a log amplitude spectrum of the audio signal based on the frequency range;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE 18. The method according to EE 17, wherein the calculation of the log amplitude spectrum comprises transforming the log amplitude spectrum from linear frequency scale to log frequency scale.

EE 19. The method according to EE 18, wherein the calculation of the log amplitude spectrum further comprises interpolating the transformed log amplitude spectrum along the frequency axis.

EE 20. The method according to EE 19, wherein the interpolation is performed based on a step size not smaller than a difference between frequencies in log frequency scale of the first highest frequency bin and the second highest frequency bin in linear frequency scale of the log amplitude spectrum.

EE 21. The method according to EE 19, wherein the calculation of the log amplitude spectrum further comprises normalizing the interpolated log amplitude spectrum through subtracting the interpolated log amplitude spectrum by its minimum component.

EE 22. The method according to EE 17, wherein the predetermined frequency range corresponds to normal human pitch range.

EE 23. The method according to EE 17, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 24. The method according to EE 23, further comprising:

performing energy-based noise estimation for each frequency of the amplitude spectrum to generate a speech presence probability, and wherein the weighting vector contains the generated speech presence probabilities.

EE 25. An apparatus for classifying an audio signal, comprising:

a feature extractor configured to extract one or more features from the audio signal; and a classifying unit configured to classify the audio signal according to the extracted features, wherein the feature extractor comprises:

a harmonicity estimator configured to generate at least two measures of harmonicity of the audio signal based on frequency ranges defined by different expected maximum frequencies; and a feature calculator configured to calculate one of the features as a difference or a ratio between the harmonicity measures, wherein the harmonicity estimator comprises:

a first spectrum generator configured to calculate a log amplitude spectrum of the audio signal based on the frequency range;

a second spectrum generator configured to derive a first spectrum by calculating each component of the first spectrum as a sum of components of the log amplitude spectrum on frequencies which, in linear frequency scale, are odd multiples of the component's frequency of the first spectrum;

derive a second spectrum by calculating each component of the second spectrum as a sum of components of the log amplitude spectrum on frequencies which, in linear frequency scale, are even multiples of the component's frequency of the second spectrum; and derive a difference spectrum by subtracting the first spectrum from the second spectrum; and a harmonicity estimator configured to generate a measure of harmonicity as a monotonically increasing function of the maximum component of the difference spectrum within a predetermined frequency range.

EE 26. The apparatus according to EE 25, wherein the calculation of the log amplitude spectrum comprises transforming the log amplitude spectrum from linear frequency scale to log frequency scale.

EE 27. The apparatus according to EE 26, wherein the calculation of the log amplitude spectrum further comprises interpolating the transformed log amplitude spectrum along the frequency axis.

EE 28. The apparatus according to EE 27, wherein the interpolation is performed based on a step size not smaller than a difference between frequencies in log frequency scale of the first highest frequency bin and the second highest frequency bin in linear frequency scale of the log amplitude spectrum.

EE 29. The apparatus according to EE 27, wherein the calculation of the log amplitude spectrum further comprises normalizing the interpolated log amplitude spectrum through subtracting the interpolated log amplitude spectrum by its minimum component.

EE 30. The apparatus according to EE 25, wherein the predetermined frequency range corresponds to normal human pitch range.

EE 31. The apparatus according to EE 25, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 32. The apparatus according to EE 31, further comprising:

a noise estimator configured to perform energy-based noise estimation for each frequency of the amplitude spectrum to generate a speech presence probability, and wherein the weighting vector contains the speech presence probabilities generated by the noise estimator.

EE 33. A method of generating an audio signal classifier, comprising:

extracting a feature vector including one or more features from each of sample audio signals; and training the audio signal classifier based on the feature vectors, wherein the extraction of the features from the sample audio signal comprises:

generating at least two measures of harmonicity of the sample audio signal based on frequency ranges defined by different expected maximum frequencies; and calculating one of the features as a difference or a ratio between the harmonicity measures, wherein the generation of each harmonicity measure based on a frequency range comprises:

calculating a log amplitude spectrum of the sample audio signal based on the frequency range;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE 34. An apparatus for generating an audio signal classifier, comprising:

a feature vector extractor configured to extract a feature vector including one or more features from each of sample audio signals; and a training unit configured to train the audio signal classifier based on the feature vectors, wherein the feature vector extractor comprises:

a harmonicity estimator configured to generate at least two measures of harmonicity of the sample audio signal based on frequency ranges defined by different expected maximum frequencies; and a feature calculator configured to calculate one of the features as a difference or a ratio between the harmonicity measures, wherein the harmonicity estimator comprises:

a first spectrum generator configured to calculate a log amplitude spectrum of the sample audio signal based on the frequency range;

a second spectrum generator configured to derive a first spectrum by calculating each component of the first spectrum as a sum of components of the log amplitude spectrum on frequencies which, in linear frequency scale, are odd multiples of the component's frequency of the first spectrum;

derive a second spectrum by calculating each component of the second spectrum as a sum of components of the log amplitude spectrum on frequencies which, in linear frequency scale, are even multiples of the component's frequency of the second spectrum; and derive a difference spectrum by subtracting the first spectrum from the second spectrum; and a harmonicity estimator configured to generate a measure of harmonicity as a monotonically increasing function of the maximum component of the difference spectrum within a predetermined frequency range.

EE 35. A method of performing pitch determination on an audio signal, comprising:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum;

identifying one or more peaks above a threshold level in the difference spectrum; and determining pitches in the audio signal as doubles of frequencies of the peaks.

EE 36. The method according to EE 35, further comprising:

for each of the peaks, generating a measure of harmonicity as a monotonically increasing function of the peak's magnitude in the difference spectrum; and identifying the audio signal as an overlapping speech segment if the peaks include two peaks and their harmonicity measures fall within a predetermined range.

EE 37. The method according to EE 36, wherein the identification of the audio signal comprises:

identifying the audio signal as an overlapping speech segment if the peaks include two peaks with the harmonicity measures falling within a predetermined range and with magnitudes close to each other.

EE38. The method according to EE 35, wherein the calculation of the log amplitude spectrum comprises transforming the log amplitude spectrum from linear frequency scale to log frequency scale.

EE 39. The method according to EE 38, wherein the calculation of the log amplitude spectrum further comprises interpolating the transformed log amplitude spectrum along the frequency axis.

EE 40. The method according to EE 39, wherein the interpolation is performed based on a step size not smaller than a difference between frequencies in log frequency scale of the first highest frequency bin and the second highest frequency bin in linear frequency scale of the log amplitude spectrum.

EE 41. The method according to EE 39, wherein the calculation of the log amplitude spectrum further comprises normalizing the interpolated log amplitude spectrum through subtracting the interpolated log amplitude spectrum by its minimum component.

EE 42. The method according to EE 35, wherein the predetermined frequency range corresponds to normal human pitch range.

EE 43. The method according to EE 35, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 44. The method according to EE 43, further comprising:

performing energy-based noise estimation for each frequency of the amplitude spectrum to generate a speech presence probability, and wherein the weighting vector contains the generated speech presence probabilities.

EE 45. The method according to EE 43, wherein the calculation of the amplitude spectrum comprises:

performing a Modified Discrete Cosine Transform (MDCT) transform on the audio signal to generate a MDCT spectrum as an amplitude metric; and converting the MDCT spectrum into a pseudo-spectrum according to $$S_k=((M_k)^2+(M_{k+1}-M_{k-1})^2)^{0.5},$$

where k is frequency bin index, and M is the MDCT coefficient.

EE 46. An apparatus for performing pitch determination on an audio signal, comprising:

a first spectrum generator configured to calculate a log amplitude spectrum of the audio signal;

a second spectrum generator configured to derive a first spectrum by calculating each component of the first spectrum as a sum of components of the log amplitude spectrum on frequencies which, in linear frequency scale, are odd multiples of the component's frequency of the first spectrum;

derive a second spectrum by calculating each component of the second spectrum as a sum of components of the log amplitude spectrum on frequencies which, in linear frequency scale, are even multiples of the component's frequency of the second spectrum; and derive a difference spectrum by subtracting the first spectrum from the second spectrum; and a pitch identifying unit configured to identify one or more peaks above a threshold level in the difference spectrum, and determine pitches in the audio signal as doubles of frequencies of the peaks.

EE 47. The apparatus according to EE 46, further comprising:

a harmonicity calculator configured to, for each of the peaks, generating a measure of harmonicity as a monotonically increasing function of the peak's magnitude in the difference spectrum; and a mode identifying unit configured to identify the audio signal as an overlapping speech segment if the peaks include two peaks and their harmonicity measures fall within a predetermined range.

EE 48. The apparatus according to EE 47, wherein the mode identifying unit is further configured to identify the audio signal as an overlapping speech segment if the peaks include two peaks with the harmonicity measures falling within a predetermined range and with magnitudes close to each other.

EE 49. The apparatus according to EE 48, wherein the calculation of the log amplitude spectrum comprises transforming the log amplitude spectrum from linear frequency scale to log frequency scale.

EE 50. The apparatus according to EE 49, wherein the calculation of the log amplitude spectrum further comprises interpolating the transformed log amplitude spectrum along the frequency axis.

EE 51. The apparatus according to EE 50, wherein the interpolation is performed based on a step size not smaller than a difference between frequencies in log frequency scale of the first highest frequency bin and the second highest frequency bin in linear frequency scale of the log amplitude spectrum.

EE 52. The apparatus according to EE 50, wherein the calculation of the log amplitude spectrum further comprises normalizing the interpolated log amplitude spectrum through subtracting the interpolated log amplitude spectrum by its minimum component.

EE 53. The apparatus according to EE 46, wherein the predetermined frequency range corresponds to normal human pitch range.

EE 54. The apparatus according to EE 46, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 55. The apparatus according to EE 54, further comprising:

a noise estimator configured to perform energy-based noise estimation for each frequency of the amplitude spectrum to generate a speech presence probability, and wherein the weighting vector contains the speech presence probabilities generated by the noise estimator.

EE 56. The apparatus according to EE 54, wherein the calculation of the amplitude spectrum comprises:

performing a Modified Discrete Cosine Transform (MDCT) transform on the audio signal to generate a MDCT spectrum as an amplitude metric; and converting the MDCT spectrum into a pseudo-spectrum according to $$S_k=((M_k)^2+(M_{k+1}-M_{k-1})^2)^{0.5},$$

where k is frequency bin index, and M is the MDCT coefficient.

EE 57. A method of performing noise estimation on an audio signal, comprising:

calculating a speech absence probability q(k,t) where k is a frequency index and t is a time index;

calculating an improved speech absence probability UV(k,t) as below $$UV(k,t)=\frac{1-h(t)}{q(k,t)(1-h(t))+1-q(k,t)},$$

where h(t) is a harmonicity measure at time t; and estimating a noise power $P_N(k,t)$ by using the improved speech absence probability UV(k,t), wherein the calculation of the improved speech absence probability UV(k,t) comprises:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum;

generating the harmonicity measure h(t) as a monotonically increasing function of the maximum component of the difference spectrum within a predetermined frequency range.

EE 58. The method according to EE 57, wherein the calculation of the log amplitude spectrum comprises transforming the log amplitude spectrum from linear frequency scale to log frequency scale.

EE 59. The method according to EE 58, wherein the calculation of the log amplitude spectrum further comprises interpolating the transformed log amplitude spectrum along the frequency axis.

EE 60. The method according to EE 59, wherein the interpolation is performed based on a step size not smaller than a difference between frequencies in log frequency scale of the first highest frequency bin and the second highest frequency bin in linear frequency scale of the log amplitude spectrum.

EE 61. The method according to EE 59, wherein the calculation of the log amplitude spectrum further comprises normalizing the interpolated log amplitude spectrum through subtracting the interpolated log amplitude spectrum by its minimum component.

EE 62. The method according to EE 57, wherein the predetermined frequency range corresponds to normal human pitch range.

EE 63. The method according to EE 57, wherein the calculation of the log amplitude spectrum comprises:

calculating an amplitude spectrum of the audio signal; weighting the amplitude spectrum with a weighting vector to suppress an undesired component; and performing logarithmic transform to the amplitude spectrum.

EE 64. The method according to EE 63, wherein the weighting vector contains the improved speech presence probabilities.

EE 65. An apparatus for performing noise estimation on an audio signal, comprising:

a speech estimating unit configured to calculate a speech absence probability q(k,t) where k is a frequency index and t is a time index, and calculate an improved speech absence probability UV(k,t) as below $$UV(k,t)=\frac{1-h(t)}{q(k,t)(1-h(t))+1-q(k,t)},$$

where h(t) is a harmonicity measure at time t;

a noise estimating unit configured to estimate a noise power $P_N(k,t)$ by using the improved speech absence probability UV(k,t); and a harmonicity measuring unit comprising:

a first spectrum generator configured to calculate a log amplitude spectrum of the audio signal;

a second spectrum generator configured to derive a first spectrum by calculating each component of the first spectrum as a sum of components of the log amplitude spectrum on frequencies which, in linear frequency scale, are odd multiples of the component's frequency of the first spectrum;

derive a second spectrum by calculating each component of the second spectrum as a sum of components of the log amplitude spectrum on frequencies which, in linear frequency scale, are even multiples of the component's frequency of the second spectrum; and derive a difference spectrum by subtracting the first spectrum from the second spectrum; and a harmonicity estimator configured to generate the harmonicity measure h(t) as a monotonically increasing function of the maximum component of the difference spectrum within a predetermined frequency range.

EE 66. The apparatus according to EE 65, wherein the calculation of the log amplitude spectrum comprises transforming the log amplitude spectrum from linear frequency scale to log frequency scale.

EE 67. The apparatus according to EE 66, wherein the calculation of the log amplitude spectrum further comprises interpolating the transformed log amplitude spectrum along the frequency axis.

EE 68. The apparatus according to EE 67, wherein the interpolation is performed based on a step size not smaller than a difference between frequencies in log frequency scale of the first highest frequency bin and the second highest frequency bin in linear frequency scale of the log amplitude spectrum.

EE 69. The apparatus according to EE 67, wherein the calculation of the log amplitude spectrum further comprises normalizing the interpolated log amplitude spectrum through subtracting the interpolated log amplitude spectrum by its minimum component.

EE 70. The apparatus according to EE 65, wherein the predetermined frequency range corresponds to normal human pitch range.

EE 71. The apparatus according to EE 65, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

EE 72. The apparatus according to EE 71, wherein the weighting vector contains the improved speech presence probabilities.

EE 73. A computer-readable medium having computer program instructions recorded thereon, when being executed by a processor, the instructions enabling the processor to execute a method of measuring harmonicity of an audio signal, comprising:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE 74. A computer-readable medium having computer program instructions recorded thereon, when being executed by a processor, the instructions enabling the processor to execute a method of classifying an audio signal, comprising:

extracting one or more features from the audio signal; and classifying the audio signal according to the extracted features, wherein the extraction of the features comprises:

generating at least two measures of harmonicity of the audio signal based on frequency ranges defined by different expected maximum frequencies; and calculating one of the features as a difference or a ratio between the harmonicity measures, wherein the generation of each harmonicity measure based on a frequency range comprises:

calculating a log amplitude spectrum of the audio signal based on the frequency range;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE 75. A computer-readable medium having computer program instructions recorded thereon, when being executed by a processor, the instructions enabling the processor to execute a method of generating an audio signal classifier, comprising:

extracting a feature vector including one or more features from each of sample audio signals; and training the audio signal classifier based on the feature vectors, wherein the extraction of the features from the sample audio signal comprises:

generating at least two measures of harmonicity of the sample audio signal based on frequency ranges defined by different expected maximum frequencies; and calculating one of the features as a difference or a ratio between the harmonicity measures, wherein the generation of each harmonicity measure based on a frequency range comprises:

calculating a log amplitude spectrum of the sample audio signal based on the frequency range;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum; and generating a measure of harmonicity as a monotonically increasing function of the maximum component of the difference spectrum within a predetermined frequency range.

EE76. The apparatus according to any of EE9-EE16, EE26-EE32, and EE65-EE72 wherein the apparatus is part of a mobile device and utilized in at least one of enhancing, managing, and communicating voice communications to and/or from the mobile device.

EE77. The apparatus according to EE76 wherein results of the apparatus are utilized to determine actual or estimated bandwidth requirements of the mobile device.

EE78. The apparatus according to EE76, wherein results of the apparatus are sent to a backend process in a wireless communication from the mobile device and utilized by the backend to manage at least one of bandwidth requirements of the mobile device and a connected application being utilized by, or being participated in via, the mobile device.

EE79. The apparatus according to EE78, wherein the connected application comprises at least one of a voice conferencing system and a gaming application.

EE80. The apparatus according to EE79, wherein results of the apparatus are utilized to manage functions of the gaming application.

EE81. The apparatus according to EE80, wherein the managed functions include at least one of player location identification, player movements, player actions, player options such as re-loading, player acknowledgements, pause or other controls, weapon selection, and view selection.

EE82. The apparatus according to EE79, wherein results of the apparatus are utilized to manage features of the voice conferencing system including any of remote controlled camera angles, view selections, microphone muting/unmuting, highlighting conference room participants or white boards, or other conference related or unrelated communications.

EE83. The apparatus according to any of EE9-EE16, EE26-EE32, and EE65-EE72 wherein the apparatus is operative to facilitate at least one of enhancing, managing, and communicating voice communications to and/or a mobile device.

EE84. The apparatus according to any of EE77, wherein the apparatus is part of at least one of a base station, cellular carrier equipment, a cellular carrier backend, a node in a cellular system, a server, and a cloud based processor.

EE85. The apparatus according to any of EE76-EE84, wherein the mobile device comprises at least one of a cell phone, smart phone (including any i-phone version or android based devices), tablet computer (including i-Pad, galaxy, playbook, windows CE, or android based devices).

EE86. The apparatus according to any of EE76-EE85 wherein the apparatus is part of at least one of a gaming system/application and a voice conferencing system utilizing the mobile device.

EE 87. A computer-readable medium having computer program instructions recorded thereon, when being executed by a processor, the instructions enabling the processor to execute a method of performing pitch determination on an audio signal, comprising:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum;

identifying one or more peaks above a threshold level in the difference spectrum; and determining pitches in the audio signal as doubles of frequencies of the peaks.

EE 88. A computer-readable medium having computer program instructions recorded thereon, when being executed by a processor, the instructions enabling the processor to execute a method of performing noise estimation on an audio signal, comprising:

calculating a speech absence probability q(k,t) where k is a frequency index and t is a time index;

calculating an improved speech absence probability UV(k,t) as below $$UV(k, t) = \frac{1 - h(t)}{q(k, t)(1 - h(t)) + 1 - q(k, t)},$$

where h(t) is a harmonicity measure at time t; and estimating a noise power $P_N(k,t)$ by using the improved speech absence probability UV(k,t), wherein the calculation of the improved speech absence probability UV(k,t) comprises:

calculating a log amplitude spectrum of the audio signal;

deriving a first spectrum by calculating each component of the first spectrum as a sum of components of the log amplitude spectrum on frequencies which, in linear frequency scale, are odd multiples of the component's frequency of the first spectrum;

deriving a second spectrum by calculating each component of the second spectrum as a sum of components of the log amplitude spectrum on frequencies which, in linear frequency scale, are even multiples of the component's frequency of the second spectrum;

deriving a difference spectrum by subtracting the first spectrum from the second spectrum;

generating the harmonicity measure h(t) as a monotonically increasing function of the maximum component of the difference spectrum within a predetermined frequency range.

The invention claimed is:

1. A method of processing an audio signal in a voice communication device, comprising:

calculating, in a first spectrum generator circuit of the device, a log amplitude spectrum (LX) of the audio signal;

deriving, in a second spectrum generator circuit, a first spectrum (LSS) by calculating each component of the first spectrum as a sum of components of the log amplitude spectrum on frequencies which, in linear frequency scale, are odd multiples of the component's frequency of the first spectrum;

further deriving, in the second spectrum generator circuit coupled to the first spectrum generator circuit, a second spectrum (LSH) by calculating each component of the second spectrum as a sum of components of the log amplitude spectrum on frequencies which, in linear frequency scale, are even multiples of the component's frequency of the second spectrum;

yet further deriving, in the second spectrum generator a harmonic-to subharmonic ratio (HSR) spectrum in a linear amplitude domain by subtracting the LSS spectrum from the LSH spectrum (HSR=LSH−LSS);

generating, in a harmonicity estimator circuit, a measure of harmonicity (H) as a monotonically increasing function of a maximum component of the HSR spectrum within a predetermined frequency range, wherein the maximum component has the most dominant harmonics; and using the harmonicity estimator circuit to generate at least two measures of harmonicity of the audio signal based on different frequency ranges defined by different expected maximum frequencies;

providing an output of the harmonicity estimator circuit to a feature calculator to classify the audio signal into at least one of several defined audio types based on at least one of a difference and ratio between harmonicity measures obtained by the harmonicity estimator circuit based on the different frequency ranges as a portion of features extracted from the audio signal, to determine a bandwidth requirement of the voice communication device; and transmitting the determined bandwidth requirement to a backend process through a communication link to manage at least one of the bandwidth requirement and an application utilized by the voice communication device.

2. The method according to claim 1, further comprising determining a degree of acoustic periodicity of the audio signal as the measure of H using the maximum component of the different spectrum through a monotonically increasing function relation between the measure of harmonicity and the maximum component of the difference spectrum, wherein the monotonically increasing function relation means that if a first maximum component is less than or equal to a second maximum component then a first measure of harmonicity (H1) through the function on the first maximum component is less than or equal to a second measure of harmonicity (H2) through the function on the second maximum component.

3. The method according to claim 2, wherein the defined audio types comprise clean speech, noisy signals, and music, and wherein the different frequency ranges comprise at least three separate frequency ranges within an overall frequency range of 75 Hz to 5000 Hz.

4. The method according to claim 1, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

5. An apparatus for processing an audio signal in a voice communication device, comprising:

a first spectrum generator circuit of the device configured to calculate a log amplitude spectrum (LX) of the audio signal;

a second spectrum generator circuit coupled to the first spectrum generator circuit to derive a first spectrum (LSS) by calculating each component of the first spectrum as a sum of components of the log amplitude spectrum on frequencies which, in linear frequency scale, are odd multiples of the component's frequency of the first spectrum; and to further derive a second spectrum (LSH) by calculating each component of the second spectrum as a sum of components of the log amplitude spectrum on frequencies which, in linear frequency scale, are even multiples of the component's frequency of the second spectrum; and yet to further derive a harmonic-to-subharmonic ratio (HSR) spectrum in a linear amplitude domain by subtracting the LSS spectrum from the LSH spectrum (HSR=LSH−LSS); and a harmonicity estimator circuit configured to determine a measure of harmonicity (H) as a monotonically increasing function of a maximum component of the HSR spectrum within a predetermined frequency range, wherein the maximum component has the most dominant harmonics; the harmonicity estimator circuit further generating at least two measures of harmonicity of the audio signal based on different frequency ranges defined by different expected maximum frequencies;

a transmission link providing an output of the harmonicity estimator circuit to a feature calculator to classify the audio signal into at least one of several defined audio types based on at least one of a difference and ratio between harmonicity measures obtained by the harmonicity estimator circuit based on the different frequency ranges as a portion of features extracted from the audio signal, to determine a bandwidth requirement of the voice communication device; and a communication link transmitting the determined bandwidth requirement to a backend process to manage at least one of the bandwidth requirement and an application utilized by the voice communication device.

6. The apparatus according to claim 5, wherein the harmonicity estimator circuit uses determines a degree of acoustic periodicity of the audio signal as a measure of harmonicity (H) using the maximum component of the different spectrum through a monotonically increasing function relation between the measure of harmonicity and the maximum component of the difference spectrum, and wherein the monotonically increasing function relation means that if a first maximum component is less than or equal to a second maximum component then a first measure of harmonicity (H1) through the function on the first maximum component is less than or equal to a second measure of harmonicity (H2) through the function on the second maximum component.

7. The apparatus according to claim 6, wherein the defined audio types comprise clean speech, noisy signals, and music, and wherein the different frequency ranges comprise at least three separate frequency ranges within an overall frequency range of 75 Hz to 5000 Hz.

8. The apparatus according to claim 5, wherein the calculation of the log amplitude spectrum comprises:

calculating an amplitude spectrum of the audio signal;

weighting the amplitude spectrum with a weighting vector to suppress an undesired component; and performing logarithmic transform to the amplitude spectrum.

* * * * *